US006837335B2

(12) United States Patent
Jankowski

(10) Patent No.: US 6,837,335 B2
(45) Date of Patent: Jan. 4, 2005

(54) REPLACEABLE CATALYST FOR EXHAUST SYSTEM

(75) Inventor: Mark Jankowski, Phoenix, AZ (US)

(73) Assignee: MTD Products Inc, Cleveland, OH (US)

( * ) Notice: Subject to any disclaimer, the term of this patent is extended or adjusted under 35 U.S.C. 154(b) by 1 day.

(21) Appl. No.: 10/280,353

(22) Filed: Oct. 25, 2002

(65) Prior Publication Data

US 2003/0141143 A1 Jul. 31, 2003

Related U.S. Application Data

(60) Provisional application No. 60/353,767, filed on Jan. 31, 2002.

(51) Int. Cl.[7] ..... F01N 7/18; F01N 1/24; F01N 1/08; F01N 3/10

(52) U.S. Cl. ..... 181/243; 181/272; 181/258; 422/181; 60/302

(58) Field of Search ..... 181/243, 217, 181/229, 272, 275, 282, 258, 230, 231; 422/177, 181; 60/299, 302

(56) References Cited

U.S. PATENT DOCUMENTS

| | | | | | |
|---|---|---|---|---|---|
| 3,889,464 | A | * | 6/1975 | Gardner | 60/286 |
| 3,960,509 | A | * | 6/1976 | Abriany | 422/181 |
| 4,032,310 | A | * | 6/1977 | Ignoffo | 433/170 |
| 4,849,185 | A | | 7/1989 | Wittig | |
| 4,969,328 | A | * | 11/1990 | Kammel | 60/275 |
| 5,139,107 | A | * | 8/1992 | Nagai | 181/240 |
| 5,169,604 | A | | 12/1992 | Crothers, Jr. | |
| 5,373,119 | A | * | 12/1994 | Suzuki et al. | 181/230 |
| 5,434,374 | A | * | 7/1995 | Hsueh | 181/228 |
| 5,547,641 | A | | 8/1996 | Smith et al. | |
| 5,722,237 | A | * | 3/1998 | Iida et al. | 60/302 |
| 5,866,859 | A | * | 2/1999 | Karlsson et al. | 181/230 |
| 6,341,662 | B1 | * | 1/2002 | Karlsson | 181/230 |
| 6,393,835 | B1 | * | 5/2002 | Stoll et al. | 60/299 |
| 2001/0037912 | A1 | | 11/2001 | Menzel | |
| 2002/0162319 | A1 | * | 11/2002 | Crocker et al. | 60/274 |
| 2003/0173148 | A1 | * | 9/2003 | Andersson et al. | 181/272 |

FOREIGN PATENT DOCUMENTS

| | | | | | |
|---|---|---|---|---|---|
| DE | 4121940 | A1 | * | 1/1993 | F01N/3/02 |
| JP | 04134118 | A | * | 5/1992 | F01N/3/28 |
| WO | WO 9418441 | A1 | * | 8/1994 | F01N/3/28 |

* cited by examiner

*Primary Examiner*—David Martin
*Assistant Examiner*—Edgardo San Martin
(74) *Attorney, Agent, or Firm*—Wegman, Hessler & Vanderburg

(57) ABSTRACT

A new and improved exhaust system as described herein, wherein the catalytic cartridge is selectively replaceable. The catalytic cartridge, which contains the catalyst, is located within the baffle tube. The baffle tube is easily inserted and removed from the housing assembly of the exhaust system, thereby making it simple and efficient to remove and replace the catalytic cartridge.

11 Claims, 11 Drawing Sheets

REPLACEABLE CATALYST FOR EXHAUST SYSTEM

This application claims priority to U.S. Ser. No. 60/353,767, entitled REPLACEABLE CATALYST FOR EXHAUST SYSTEM, filed Jan. 31, 2002.

BACKGROUND OF THE INVENTION

1. Field of the Invention

This invention relates to an exhaust system for a two-cycle engine, and more particularly to a catalytic cartridge for a two-cycle engine, and even more particularly to a replaceable catalytic converter cartridge for a two-cycle engine.

2. Description of the Related Art

Current exhaust systems have the catalytic cartridge, which contains the catalyst, enclosed within the housing assembly of the exhaust system. The catalyst cartridge is securely in place within the housing assembly, and cannot be easily removed. In fact, in the current state of the art, if the catalytic cartridge needs to be replaced, the entire housing assembly needs to be replaced, because the catalytic cartridge cannot be easily removed. Therefore, it is the object of this invention to make an easily replaceable, and removable catalytic cartridge for a two-cycle engine.

SUMMARY OF THE INVENTION

In accordance with one aspect of the present invention, an exhaust system for a two-cycle engine includes a housing assembly, the assembly having a first housing section and a second housing section, a housing opening, a baffle tube, the baffle tube being received by the housing opening, a mounting plate, the mounting plate fixedly attached to the baffle tube, a catalytic cartridge, the catalytic cartridge located within the baffle tube, a catalyst, the catalyst located within the catalytic cartridge, an alum gasket, an intake, the intake having an intake plate and a side intake opening, and connecting means for connecting the intake plate, the gasket, and the mounting plate to the housing front via receiving means.

In accordance with another aspect of the present invention, an exhaust system for an engine comprising a housing, and a selectively replaceable catalytic cartridge.

In accordance with still another aspect of the present invention, the system further comprises a baffle tube, the baffle tube being selectively removable from the housing, and a catalyst, the catalyst located within the catalytic cartridge.

In accordance with yet another aspect of the present invention, the system the system further comprises an intake, a mounting plate, an alum gasket, with the intake, mounting plate, and gasket all being connected to the housing.

In accordance with another aspect of the present invention, the housing further includes a first and second section a housing opening, and a baffle, the baffle containing diffuser openings, the baffle located within the housing.

In accordance with still another aspect of the present invention, a muffler for a two cycle engine, the muffler comprising a housing, an intake, a baffle tube, a catalytic cartridge, the cartridge located within the baffle tube, and a catalyst, the catalyst located within the catalytic cartridge, the cartridge being selectively removable.

In accordance with yet another aspect of the present invention, the baffle tube is located within the housing, the muffler further includes a first housing section, a second housing section, and a baffle, the baffle containing diffuser openings, the baffle located within the housing.

In accordance with another aspect of the present invention, the muffler further comprises a front plate, a gasket ring, the gasket ring being circumferentially enclosed within the gasket, connecting sleeves for connecting the housing sections and the baffle, an exhaust flange, the exhaust flange located on a front plate, the front plate containing the intake, and a side intake opening.

In accordance with another aspect of the present invention a method for replacing a catalytic cartridge, include the steps of removing an associated baffle tube from an associated housing, removing the catalytic cartridge from the baffle tube, and inserting a second catalytic cartridge.

In accordance with another aspect of the present invention the method further comprises the steps of removing an associated intake and removing an associated gasket.

In accordance with another aspect of the present invention a method for replacing a catalytic cartridge, includes the steps of providing a housing assembly, the housing assembly having first and second section, providing a baffle, the baffle having diffuser openings, assembling the first and second sections, the baffle located within the assembly; providing a catalyst within a catalytic cartridge, inserting the cartridge into a baffle tube, inserting the baffle tube into the assembly, attaching a gasket to the baffle tube, attaching an intake to the gasket, detaching the intake from the gasket, detaching the gasket from the baffle tube, removing the baffle tube from the assembly, removing the cartridge from the baffle tube, and inserting a second catalytic cartridge.

These and other objects, features, and advantages of the present invention are readily apparent from the following detailed description of the best mode for carrying out the invention when taken in conjunction with the accompanying drawings.

BRIEF DESCRIPTION OF THE DRAWINGS

The invention may take physical form in certain parts and arrangement of parts, several embodiments of which will be described in detail in this specification and illustrated in the accompanying drawings which form a part hereof and wherein.

DESCRIPTION OF THE INVENTION

Figure 1:
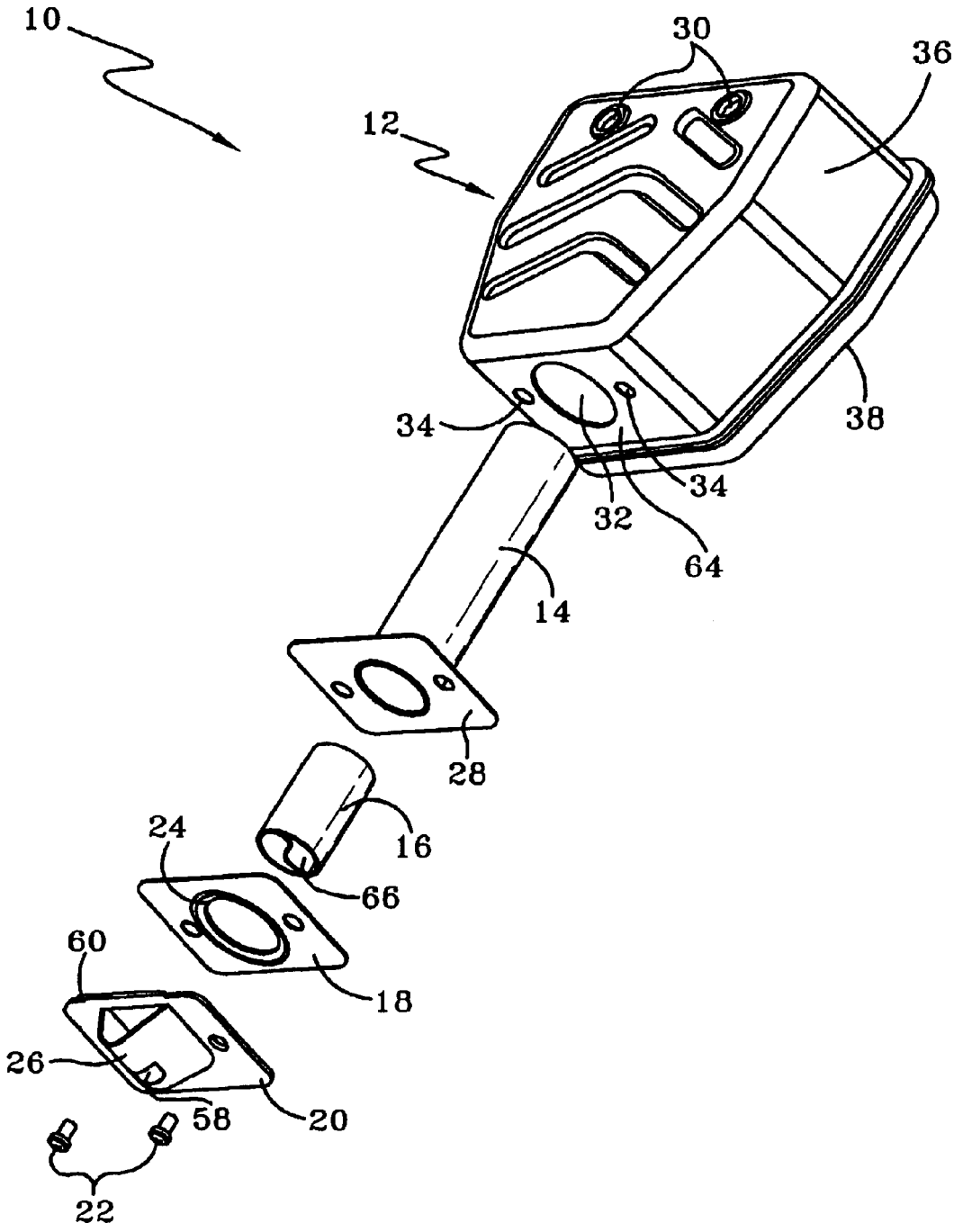
FIG. 1 is a perspective view of the new exhaust system, showing the replaceable catalyst.
Figure 1A:
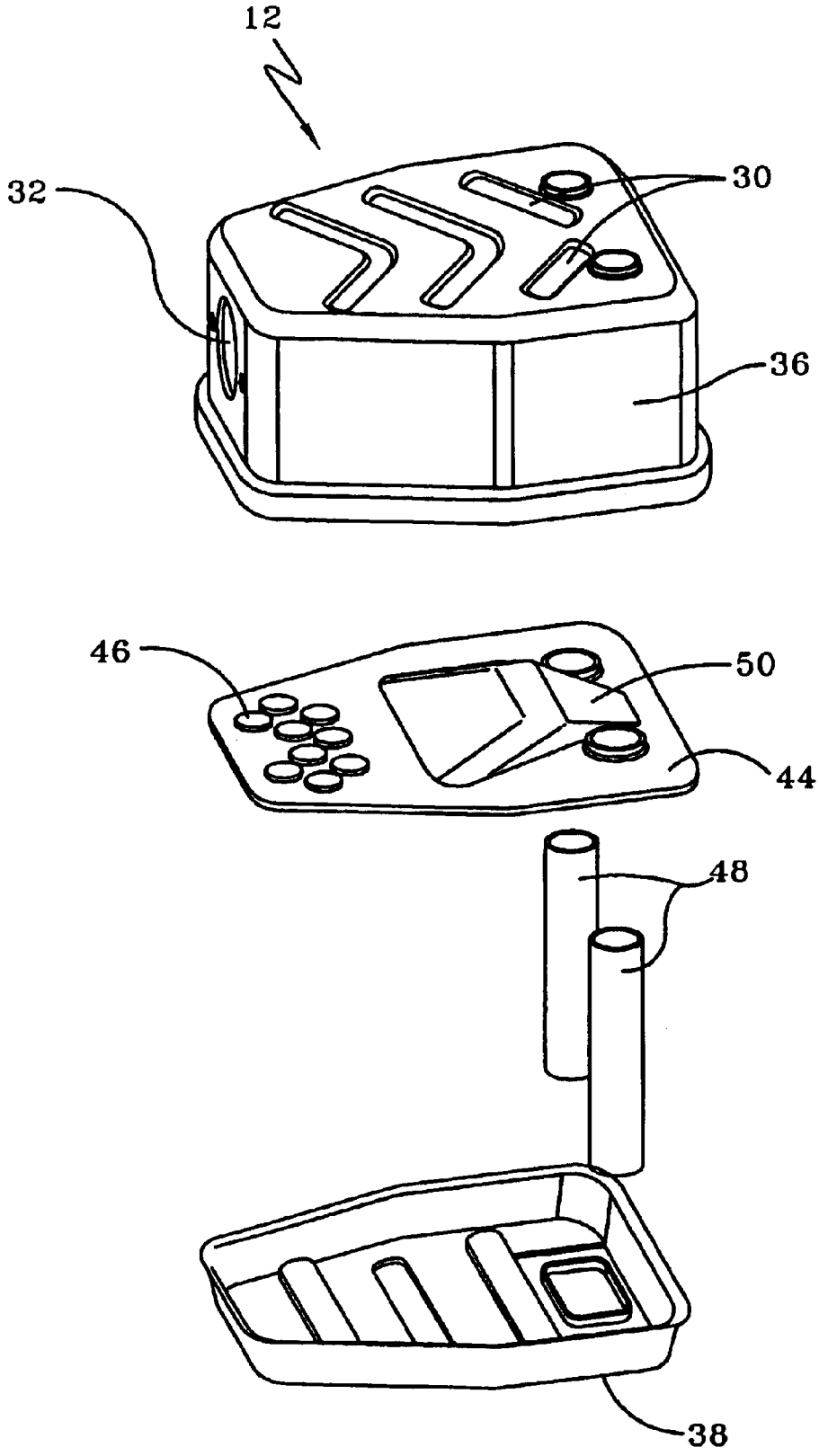
FIG. 1A is a perspective view of the housing.

FIGS. 1–11 illustrate the present invention. In this embodiment, a new exhaust system 10 is shown and described. The exhaust system 10 has a housing 12, which is comprised of a first housing section 36, a second housing section 38, a housing front 64, receiving means 34, grooves 30 for adding strength for stamping, a housing opening 32, a baffle 44, diffuser openings 46, sleeves 48, baffle tube 14, mounting plate 28, catalytic cartridge 16, catalyst 66, gasket 18, gasket ring 24, front plate 20, exhaust flange 60, side intake opening 58, exhaust outlet 26, and connecting means 22.

As shown in FIG. 1, the first and second housing sections 36, 38 connect together to form the housing 12. The baffle tube 14 fits inside the housing 12, via housing opening 32. The mounting plate 28 rests against the housing front 64, and lines up with receiving means 34. The catalytic cartridge 16, which contains the catalyst 66, is inserted into the baffle tube 14, and gasket 18 is placed over the mounting plate 28, and is held in place by the front plate 20. The front plate 20, gasket 18, and mounting plate 28 are all connected to the housing 12 at the housing front 64 by connecting means 22, which in this particular embodiment are screws. It is to be understood that the particular embodiment of this invention is not intended to limit the invention in any manner, but is merely shown to illustrate the invention. It is to be understood that any means of inserting the catalytic cartridge 16 into the exhaust system 10, such that the catalytic cartridge 16 is easily replaceable, is to be encompassed within this invention.

Figure 2:
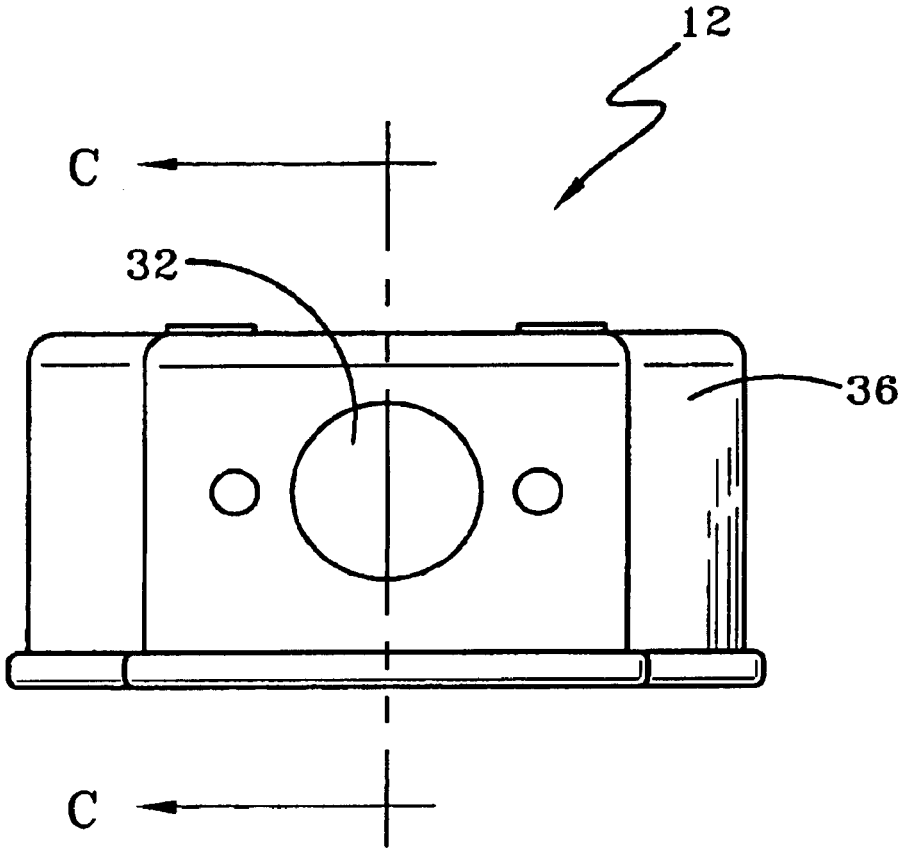
FIG. 2 is a front view of the exhaust system.
Figure 3:
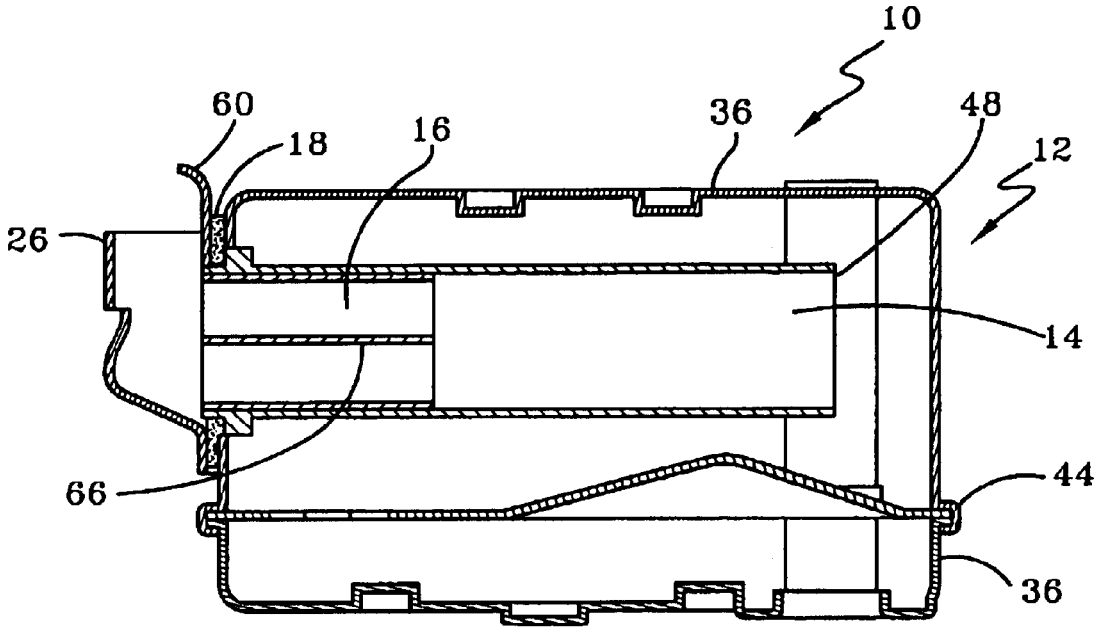
FIG. 3 is a cross-sectional view of line C—C in FIG. 2.

FIG. 3 shows a cross-sectional view of the exhaust system 10, taken along line C—C of FIG. 2. The catalyst 66 is inside catalytic cartridge 16, which in turn is located inside the baffle tube 14. This particular configuration of the exhaust system 10 allows the catalytic cartridge 16 to be easily replaced.

Figure 3A:
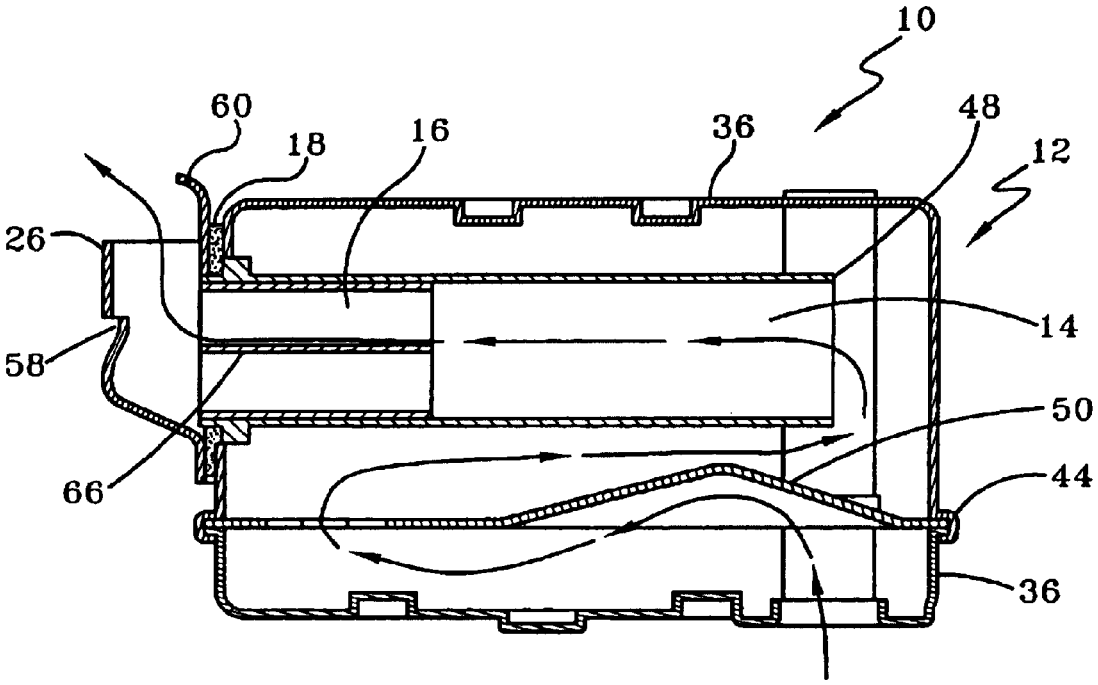
FIG. 3A is a cross-sectional view of line C—C in FIG. 2, showing the path of the exhaust.
Figure 4:
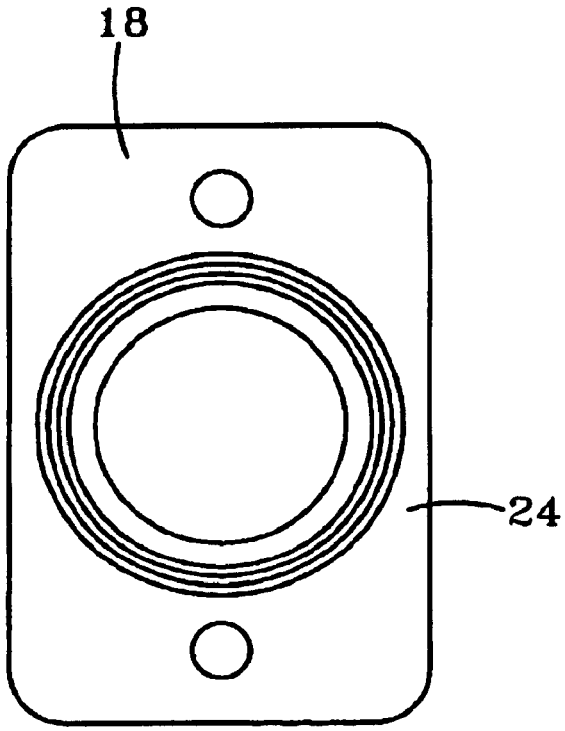
FIG. 4 is a perspective view of the alum gasket.
Figure 5:
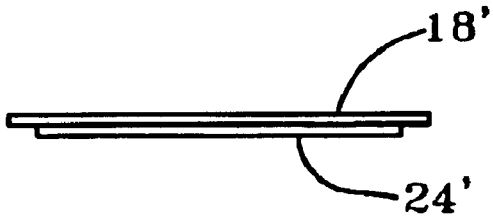
FIG. 5 is a side view of the alum gasket.
Figure 6:
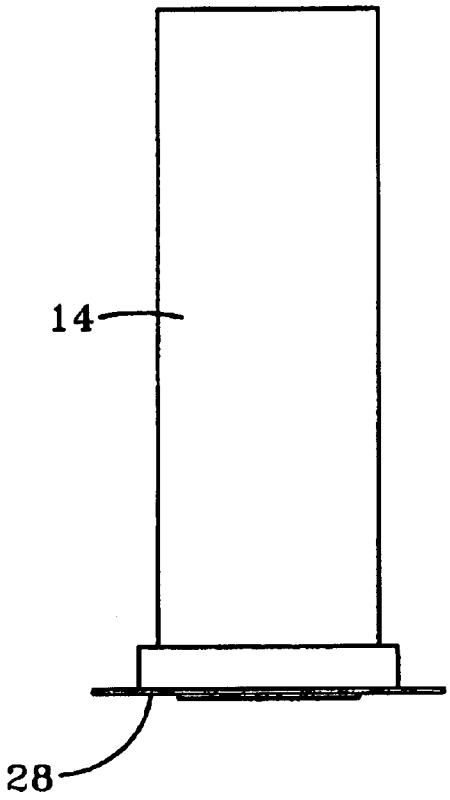
FIG. 6 is a perspective view of the baffle tube.
Figure 7:
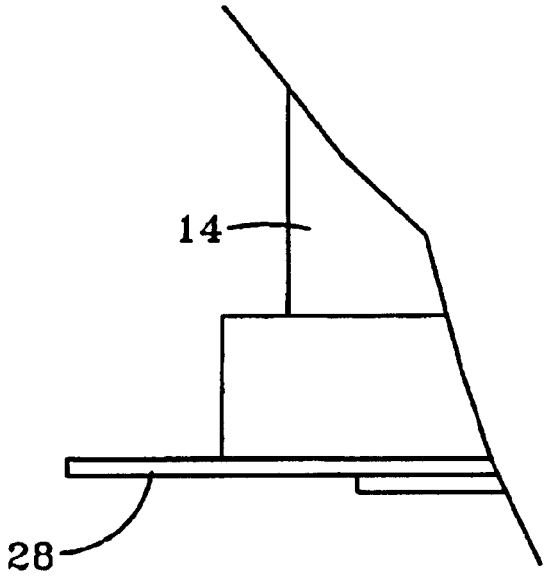
FIG. 7 is an exploded view of portion A of FIG. 6.
Figure 8:
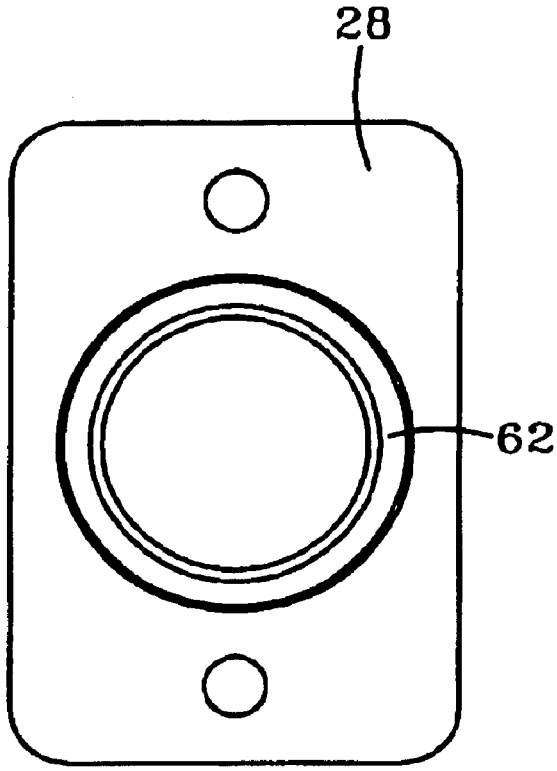
FIG. 8 is a front view of the mounting plate.
Figure 9:
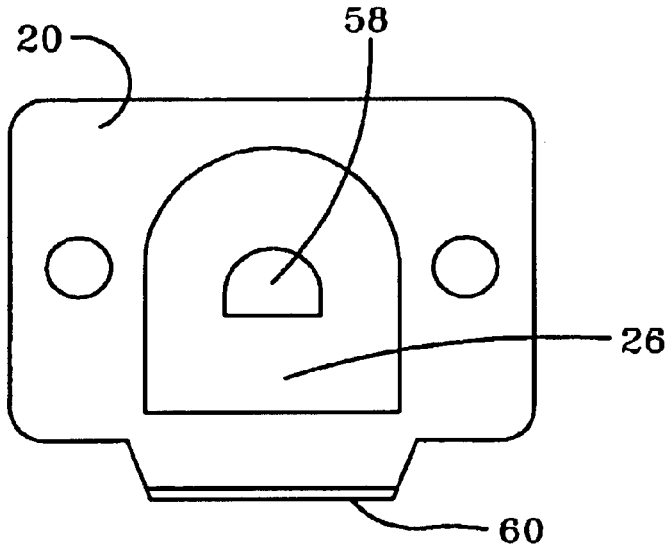
FIG. 9 is a front view of the intake.
Figure 10:
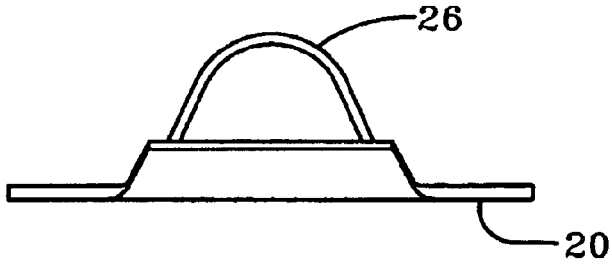
FIG. 10 is a top view of the intake.
Figure 11:
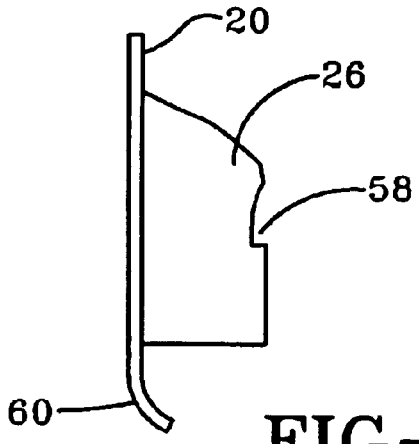
FIG. 11 is a side view of the intake.

With reference now to FIG. 3A, the same cross-sectional view as FIG. 3 is shown. However, FIG. 3A shows the movement of the exhaust through the system 10. The exhaust enters the system 10 through the second housing 38, and then makes contact with raised portion 50 of the baffle 44. (The raised portion 50 reduces back pressure when the exhaust enters the system 10.) The exhaust then passes through the diffusion openings 44 and then travels back toward the opening of the baffle tube 14. The exhaust travels through the baffle tube 14 into the catalytic cartridge 16, where it reacts with the catalyst 66. The exhaust then passes into the exhaust outlet 26 and is deflected outwardly from the system 10 by the exhaust flange 60. The passage of the exhaust through the exhaust outlet 26 creates a vacuum which draws air through side intake opening 58. The air entering through the side intake opening 58 cools down the temperature of the exhaust.

As can be seen in FIGS. 1–11, the catalytic cartridge 16 can be easily removed from the baffle tube 14, by simply removing the connecting means 22, the front plate 20, the gasket 18, and the baffle tube 14. This is easily accomplished by unscrewing the connecting means 22 and pulling off the plates 18, 20, 28. Once the baffle tube 14 is removed, the catalytic cartridge 16 easily slides out of the baffle tube 14, and therefore can be replaced with a new catalytic cartridge.

Figure 12:
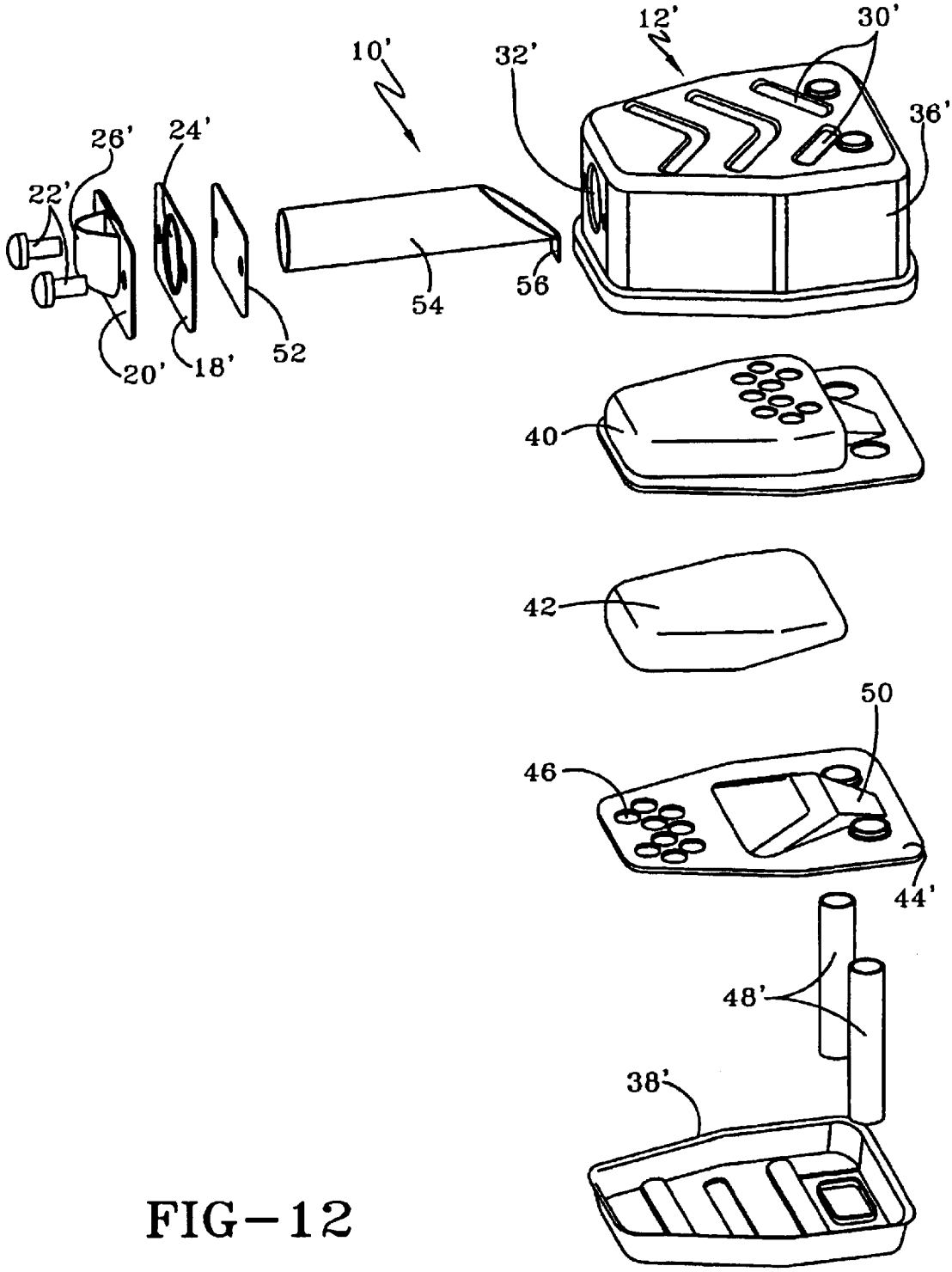
FIG. 12 is a perspective view of another embodiment of the exhaust system.
Figure 13:
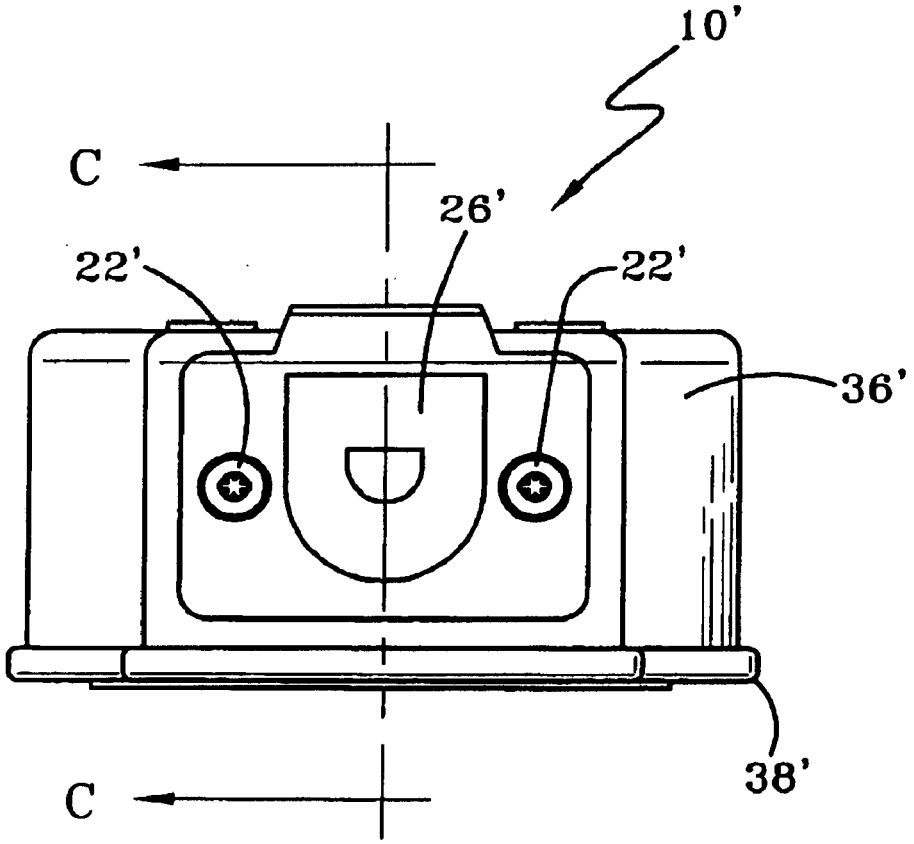
FIG. 13 is front view of the exhaust system of FIG. 12.
Figure 14:
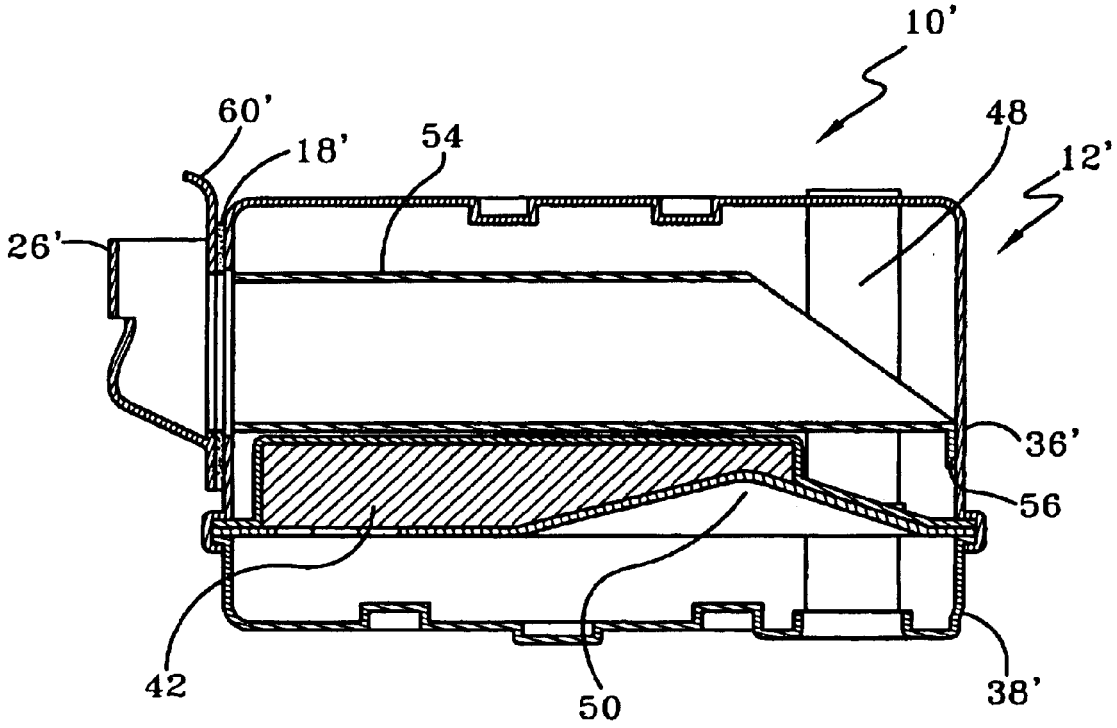
FIG. 14 is a cross-sectional view along line C—C of FIG. 13.

FIGS. 12–14 show another embodiment of the exhaust system 10'. As can be seen in FIG. 12, the exhaust system 10' is similar to the exhaust system 10. However, the catalyst 42 is located inside the housing assembly 12' and is located between a first baffle 40 and second baffle 44'. These baffles 40', 44' are fixedly attached to each other.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. An exhaust system for a two cycle engine comprising:

a housing assembly configured to receive exhaust from the engine, said housing having a housing opening in an outer face thereof;

a baffle tube, the baffle tube being received by the housing opening;

a mounting plate, the mounting plate fixedly attached to the baffle tube;

a catalytic cartridge, the catalytic cartridge removably insertable within the baffle tube the catalytic cartridge containing a catalyst, the catalyst located within the catalytic cartridge;

a gasket;

an outlet plate securable to the face of the housing assembly to cover the opening, the outlet plate being removable from the housing assembly to permit replacement of the catalytic cartridge, and, connecting means for connecting the outlet plate, the gasket, and the mounting plate to the housing assembly front via receiving means to secure the catalytic cartridge within the housing assembly.

2. An exhaust system for a two cycle engine, the exhaust system comprising:

a housing configured to receive exhaust from the associated engine, said housing having an opening in a front face thereof;

a baffle tube insertable into the opening in the housing;

a catalytic cartridge removably insertable within the baffle tube, the catalytic cartridge containing a catalyst; and a front plate securable to the front face of the housing, the front plate configured to cover the opening and secure the catalytic cartridge within the housing, the front plate being removable from the housing to permit replacement of the catalytic cartridge.

3. The exhaust system of claim 2, wherein the housing comprises a first housing section and a second housing section and a baffle, the baffle containing diffuser openings, the baffle located within the housing.

4. The exhaust system of claim 3, wherein the exhaust system further comprises connecting sleeves for connecting the housing sections and the baffle.

5. A method for replacing a catalytic cartridge in an exhaust system for an associated engine, the method comprising the steps of:

removing a plate from a face of an exhaust system housing to expose an opening in the housing;

removing a baffle tube from the opening in the housing;

removing the catalytic cartridge from the baffle tube;

inserting a second catalytic cartridge into the baffle tube;

returning the baffle tube into the opening in housing and securing the plate over the opening.

6. The exhaust system of claim 1, wherein the outlet plate comprises an exhaust outlet such that exhaust received by the housing flows through the baffle tube and the catalytic cartridge, thereby coming in contact with the catalyst, and then exits the housing assembly through the outlet plate, wherein the outlet plate further comprises a side intake opening such that exhaust exiting the exhaust outlet causes ambient air to be drawn through the side intake opening to cool the exhaust.

7. The exhaust system of claim 2, wherein the baffle tube is removably insertable into the housing opening.

8. The exhaust system of claim 2, wherein the front plate comprises an exhaust outlet such that exhaust received by the housing flows through the baffle tube and the catalytic cartridge, thereby coming in contact with the catalyst, and then exits the housing through the front plate, wherein the outlet plate further comprises a side intake opening such that exhaust exiting the exhaust outlet causes ambient air to be drawn through the side intake opening such that ambient air is mixed with the exhaust as the exhaust passes through the exhaust outlet.

9. The exhaust system of claim 2, further comprising connecting means for removably securing the front plate to the housing.

10. The exhaust system of claim 2, wherein the baffle tube permits exhaust to flow through ends of the tube but is impervious to the flow of exhaust through the sidewall of the tube.

11. An exhaust system for a small engine having a selectively replaceable catalytic cartridge, the exhaust system comprising:

a housing configured to receive exhaust from the associated engine, said housing comprising an interior baffle plate containing diffuser openings defining an exhaust flow path through the housing, said housing further defining an opening in a front face thereof;

a baffle tube insertable into the opening in the front face of the housing, wherein the baffle tube has open ends and a sidewall such that the baffle tube receives exhaust flowing through the housing through one end of the baffle tube but is impervious to the flow of exhaust through the sidewall thereof;

a catalyst containing cartridge removably insertable within the baffle tube; and a front plate securable to the front face of the housing thereby covering the opening and securing the catalytic cartridge within the housing, the front plate comprising an exhaust outlet such that exhaust flowing through the housing flows in a circuitous path through the diffuser openings in the baffle plate then back through the end of the baffle tube thereby coming in contact with the catalyst containing cartridge, and then exits the housing through the exhaust outlet in the front plate, wherein the front plate is removable from the housing to permit replacement of the catalytic cartridge.

* * * * *